United States Patent [19]

Samuels et al.

[11] 3,950,055

[45] Apr. 13, 1976

[54] WEATHERPROOF ELECTRICAL RECEPTACLE WITH COVER HOLDUP FEATURE

[75] Inventors: Allen J. Samuels, Bethel Park, Pa.; Roy O. Wiley, Huntington, Conn.

[73] Assignee: Westinghouse Electric Corporation, Pittsburgh, Pa.

[22] Filed: May 20, 1974

[21] Appl. No.: 471,733

[52] U.S. Cl. ..... 339/44 R; 174/67; 220/290; 220/291

[51] Int. Cl.[2] ..... H01R 13/44

[58] Field of Search ..... 339/36, 43, 44; 222/550; 220/291, 292, 335, 290; 174/66, 67

[56] References Cited

UNITED STATES PATENTS

| | | | |
|---|---|---|---|
| 1,334,172 | 3/1920 | Ryerson | 174/67 |
| 1,474,758 | 11/1923 | Bissell | 339/36 X |
| 1,836,811 | 12/1931 | McNeal | 220/291 |
| 1,912,277 | 5/1933 | Kaye | 220/291 |
| 2,488,188 | 11/1949 | Halvorson | 220/335 X |
| 3,140,344 | 7/1964 | Slater et al. | 339/44 R X |
| 3,225,971 | 12/1965 | Curci | 222/550 |
| 3,258,731 | 6/1966 | Still et al. | 339/36 |

FOREIGN PATENTS OR APPLICATIONS

| | | | |
|---|---|---|---|
| 521,132 | 5/1940 | United Kingdom | 339/44 R |
| 254,362 | 7/1926 | United Kingdom | 222/550 |

*Primary Examiner*—Joseph H. McGlynn
*Assistant Examiner*—Craig R. Feinberg
*Attorney, Agent, or Firm*—G. H. Telfer

[57] ABSTRACT

A threaded cover is pivotally secured to a strap that is hinged to the base of the cover plate, the strap and base having cooperative means for holding the cover in an up position away from the access port to the receptacle merely by raising the strap to a position substantially perpendicular from the base, such as by the strap being L-shaped with a loop in the leg of the L encircling a pin secured to the base with the loop being shaped to slide over the pin when the cover is raised and to bear against the base in a locked open position.

2 Claims, 4 Drawing Figures

WEATHERPROOF ELECTRICAL RECEPTACLE WITH COVER HOLDUP FEATURE

BACKGROUND OF THE INVENTION

This invention relates generally to electrical wiring devices and, particularly, to electrical wiring devices having a weatherproof cover.

Protection of electrical contact elements of a wiring device, such as a receptacle with either male or female contact elements, has been provided by having a cover threadably secured to a threaded rim of an acess port to the contacts. Various means have been employed for securing the threaded cover to the cover plate in some way so that the cover will not be lost when it is removed from the access port rim. Sometimes the cover has been merely fastened on a chain to the cover plate. In other known devices the cover is fastened on a strap to the cover plate, the strap being spring biased so as to tend to force the cover into its closed position at all times even when a cord and plug are engaged with the receptacle. Such devices have generally good performance in many common types of applications. In marine applications, that is, particularly for receptacles that are located on watercraft, effective weatherproofing of receptacles is particularly necessary because of the corrosive atmosphere. Covers that are free to move will do so because of the rocking of the boat and can cause considerable scratching of adjacent surfaces and an undesirably high level of noise.

SUMMARY OF THE INVENTION

In accordance with this invention, a threaded cover is pivotally secured to a strap that is hinged to the base of the cover plate, the strap and base having cooperative means for holding the cover in an up position away from the access port to the receptacle merely by raising the strap to a position substantially perpendicular from the base. In a preferred form, the strap is L-shaped with a loop in the leg of the L encircling a pin secured to the base with the loop being shaped to slide over the pin when the cover is raised and to bear against the base in a locked open position.

Additional features of a weatherproof receptacle in accordance with this invention, in its preferred form, are a non-metallic washer acting as a cushion around the pin on which the cover is pivotally mounted so as to minimize likelihood of contact of the cover and the strap that would otherwise be a source of undesired noise and non-metallic washers acting as cushions between the strap and the adjacent supports to avoid contact that would otherwise be an additional source of noise. The weatherproof quality of the receptacle is enhanced by having a rubber O-ring seal at the base of the threaded rim of the access port against which the cover bears when in its fully secured position.

DESCRIPTION OF THE PREFERRED EMBODIMENT

Figure 1:
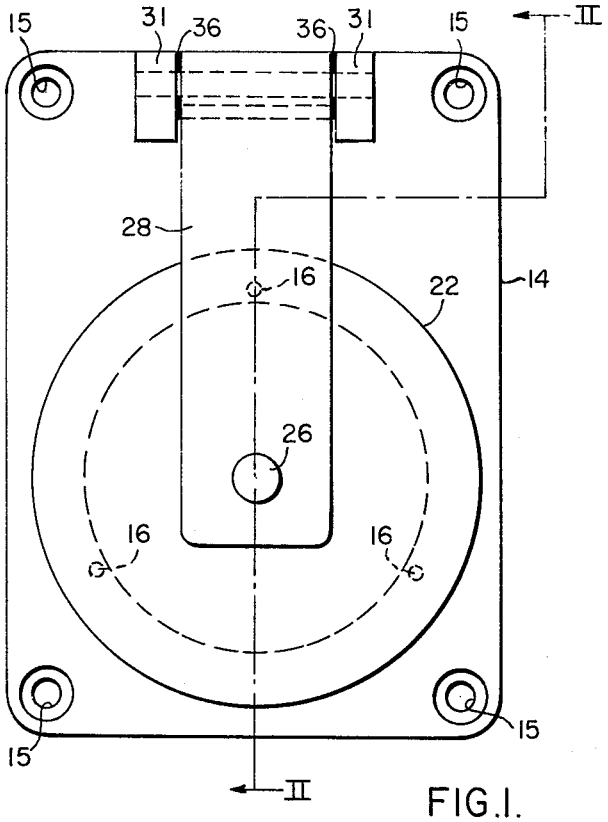
FIG. 1 is a front elevation view of a weatherproof receptacle in accordance with one embodiment of the present invention, with the cover of the receptacle in the closed position.
Figure 2:
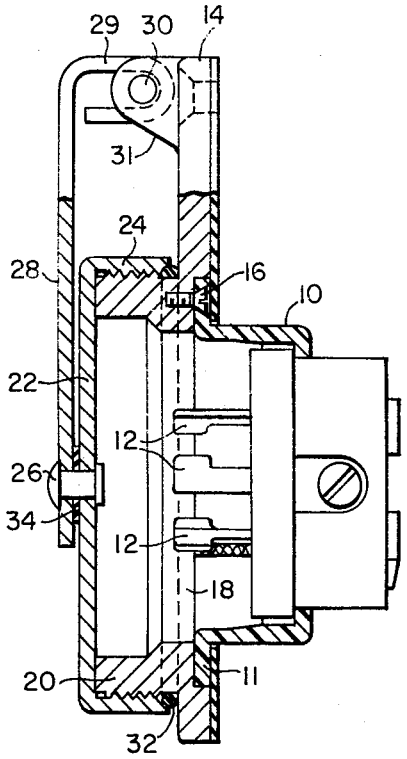
FIG. 2 is a partial cross-sectional view taken along the line II—II of FIG. 1.

Referring to FIGS. 1 and 2, there is shown an electrical receptacle in accordance with the present invention that is particularly suitable for use in corrosive atmospheres such as near salt water and on watercraft. The receptacle comprises a housing 10, of an insulating material, that contains electrical contact elements 12. In this particular embodiment, the electrical contact elements 12 are male contact elements extending outwardly from the housing 10, although naturally, the receptacle can also be made with a female configuration.

The receptacle has a cover plate or base 14, with fastener apertures 15 for securing it and the receptacle housing together to a fixed partition as in conventional use. In this connection, FIG. 1 shows the location of screw fasteners 16 that extend through a flange-like portion 11 of the housing into the cover plate 14.

The cover plate or base 14 has an access port 18 or opening through it by which connection to the contact members 12 can be made. Around the access port 18 is a threaded rim 20, here exteriorly threaded, and a cover 22 with a rim 24 that has interior threads and is mated to the access port rim. The cover 22 is pivotally secured on a pin 26 that extends through an opening in a strap 28. The strap 28 is hinged to the base 14 by hinge pin 30.

The hinge of the strap 28 to the base 14 permits movement of the strap from a generally vertical position that is parallel to the base, as shown in FIGS. 1 and 2, to a position in which the strap is generally perpendicular to the base and with the cover 22 being carried by the strap through such movement. Furthermore, the strap 28 and the base 14 have mutually cooperative means for holding the cover 22 in an up position away from the access port 18 merely by the raising of the strap to the position substantially perpendicular from the base.

In the illustrated embodiment, the strap 28 is generally L-shaped and the means for holding the cover in an up position includes hinge pin 30 secured between supports 31 on the base and running through a loop 29 in the leg of the L-shaped strap. In this form, the loop 29 is generally elongated so that upon the raising of the cover 22 and the strap 28 to a substantially perpendicular position with respect to the base 14, the loop slides down over the pin 30 so that the short leg of the L bears against the base, and the strap and cover are held in the up position.

Figure 3:
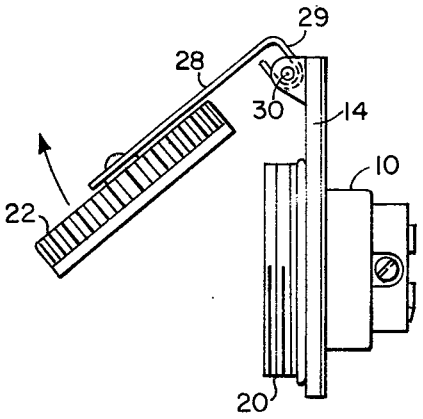
FIG. 3 is a side elevation view of an embodiment with the cover in a partially open position during the course of being fully opened; and, FIG. 4 is a side elevation view of an embodiment of the present invention with the cover in its fully open position.
Figure 4:
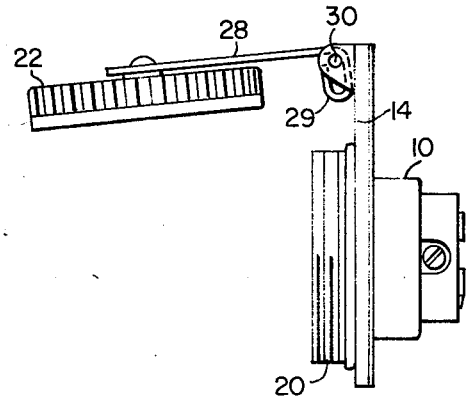

FIG. 3 is a view of the device as the cover 22 and strap 28 are being raised. FIG. 4 is a view of the device with the cover 22 in the fully open position and locked in that position by the loop 29 in the strap 28 bearing against the base 14 of the cover.

As a further aid in protecting the contacts of the device against contamination by a corrosive atmosphere, an O-ring 32, such as of rubber, is located on the base of the access port rim 20. The cover rim 24 bears against the O-ring 32 when fully threaded on the access port rim 20.

Additional features that aid in the reduction of noise from clattering metal parts are a non-metallic washer 34 of a material such as neoprene that encircles the pin 26 on which the cover 22 pivots and which minimizes metallic contact between the cover and strap 28. Additionally, washers 36 of a non-metallic material, such as nylon, are located on pin 30 between the sides of the strap 28 and the adjacent supports 31 for the pin.

We claim:

1. A weatherproof electrical receptacle comprising: a housing containing electrical contacts; a cover plate on the housing to protect the contacts when not in use while permitting access to the contacts for use, the cover plate having a generally flat base, an access port to the contacts through the base, a threaded rim fixed to the base surrounding the access port, and a cover for the access port threadably engaging the threaded rim of the access port; the cover being pivotally secured to a strap that is hinged to the base, the strap being generally L-shaped with a loop at the end thereof around a pin secured to the base, the loop being shaped to slide over the pin when the cover is raised and to bear against the base holding the cover in a latched-open position, wherein the loop in the leg of the L-shaped strap being such that when the cover is in the closed position, the internal dimension of the loop normal to the base is substantially greater than the maximum cross-sectional dimension of the pin running through the loop while the internal dimension of the loop parallel to the base is approximately the same as that of the pin with adequate clearance for movement.

2. The subject matter of claim 1 further comprising an O-ring of compressible material located around the access port rim against the base, the cover rim engaging the O-ring when it is secured on the access port rim, a non-metallic washer of compressible material located on a pin by which the cover is pivotally secured to the strap in order to minimize direct metallic contact between the cover and the strap, and washers of non-metallic material located between the lateral extremes of the strap and the adjacent mounting for the pin secured to the base on which the strap is hinged for minimizing metallic contact therebetween.

* * * * *